US006763220B2

(12) United States Patent
Nakazawa

(10) Patent No.: US 6,763,220 B2
(45) Date of Patent: Jul. 13, 2004

(54) PRINTING SYSTEM AND METHOD FOR PRINTING ON BOTH SURFACES OF WEB

(75) Inventor: Souichi Nakazawa, Hitachinaka (JP)

(73) Assignee: Hitachi Printing Solutions, Ltd., Kanagawa-ken (JP)

( * ) Notice: Subject to any disclaimer, the term of this patent is extended or adjusted under 35 U.S.C. 154(b) by 0 days.

(21) Appl. No.: 10/366,612

(22) Filed: Feb. 14, 2003

(65) Prior Publication Data

US 2003/0165349 A1 Sep. 4, 2003

(30) Foreign Application Priority Data

Mar. 1, 2002 (JP) ..... P2002-056494

(51) Int. Cl.[7] ..... G03G 15/00
(52) U.S. Cl. ..... 399/401; 101/93.11; 400/583.3
(58) Field of Search ..... 101/93.01, 93.11, 101/93.12, 179, 181, 484, 485, 220, 221, 223; 399/301, 384, 387, 401; 400/582, 583, 583.3, 583.4; 355/23, 24, 407, 408

(56) References Cited

U.S. PATENT DOCUMENTS 4,912,491 A * 3/1990 Hoshino et al. ..... 347/116
4,965,597 A * 10/1990 Ohigashi et al. ..... 347/118
5,160,946 A * 11/1992 Hwang ..... 347/116
5,266,976 A * 11/1993 Ohigashi et al. ..... 347/116
5,868,069 A * 2/1999 Khalid et al. ..... 101/93.01
6,125,751 A * 10/2000 Korem ..... 101/180
6,650,864 B2 * 11/2003 Miyamoto et al. ..... 399/384
6,684,051 B2 * 1/2004 Miyamoto et al. ..... 399/384
2002/0081132 A1 6/2002 Miyamoto et al.

* cited by examiner

*Primary Examiner*—Ren Yan
(74) *Attorney, Agent, or Firm*—McGuireWoods LLP

(57) ABSTRACT

A second printing unit includes a mark detection means for detecting a positioning mark that a first printing unit has formed on a front surface of a web. A control means controls web-transport speed in the second printing unit so that a time difference between a generation timing of a CPF-N signal and a detection timing of the positioning mark becomes constant, and also stores the web-transport speed into a memory. During a subsequent printing operation, a web-transport speed is controlled to be the same as the web-transport speed stored in the memory for a period until a positioning mark is first detected after the printing is started.

18 Claims, 7 Drawing Sheets

TABLE 1

| MARK DETECTION TIME (tm1) | WEB-TRANSPORT SPEED UPDATE AMOUNT (Δv1) |
|---|---|
| >> t1 | ↑ |
| ↑ | +3 |
| FRONT SIDE: DELAY | +2 |
| ↑ | +1 |
| = t1 | ±0 |
| ↓ | −1 |
| FRONT SIDE: AHEAD | −2 |
| ↓ | −3 |
| << t1 | ↓ |

PRINTING SYSTEM AND METHOD FOR PRINTING ON BOTH SURFACES OF WEB

BACKGROUND OF THE INVENTION

1. Field of the Invention

The present invention relates to a printing system and method for forming images on both front and rear surfaces of a web and particularly to a printing system that includes a positioning control unit that controls accurate positioning of the images on both surfaces.

2. Description of the Related Art

Printing systems have been known for forming images and the like on both surfaces of a web, such as an elongated and continuous band-shaped sheet. One system that has been proposed and put into actual use includes two printing devices arranged in series. A first printing device at a front stage performs printing on a front surface of a web. After the web is discharged outside the first printing device, an inversion unit inverts the front and rear surfaces of the web. Then, the web is supplied to a second printing device at a post stage, which performs printing on a rear surface of the web.

Two types of webs are used in this system. Once type of web is a consecutive sheet formed with a row of sprocket holes on each lengthwise edge. The other type of web is a consecutive sheet with no sprocket holes. Systems that can use either type of web are becoming popular. However, when a web with no sprocket holes is used, it can be difficult to align the rear-surface image with the front-surface image.

This is particularly a problem when the first printing device is a type of printing device that forms images using electrophotographic techniques. That is, heat generated to thermally fix the toner image transferred onto the web in place can thermally shrink the web from its initial condition. As a result, the web can be shorter when fed to the second printing device.

Accordingly, because the page length when the front surface is printed on differs from the page length when the rear surface is printed on, the position of the rear-surface image formed in the second printing device will not match the position of the front-surface image formed in the first printing device.

SUMMARY OF THE INVENTION

In order to overcome the above problems, it is conceivable to use the first printing device to form positioning marks at predetermined positions on the web. The second printing device can measure the interval or detection timing of positioning marks. Then, web-transport speed in the second printing device can be controlled based on the measurement results so that position of the rear-surface image is aligned with the position of the front-surface image.

However, this conceivable configuration has some shortcomings. Positing control cannot be performed at the start of printing during the period from when web transport begins until the first positioning mark is detected. For this reason, positioning control can only be performed for a very short time when only one page, for example, is printed. For this reason, positioning control processes are stopped before operations to match positions of the front-surface and rear-surface images are completed. In the end, the problem of positional shift between the front-surface and the rear-surface images cannot be resolved. If this problem of the positioning control process being stopped midway continues, then the positional shift between the front-surface and rear-surface images accumulates, so that positional shift becomes increasingly large.

It is an objective of the present invention to overcome the above-described problems and provide a dual surface printing system and method capable of performing positioning control to match the positions of front-surface and rear-surface images even during the period from start of printing to when the first detection mark is detected. It is a further objective of the present invention to provide a dual surface printing system capable of accurately positioning front-surface and rear-surface images during an extremely short period of time.

In order to overcome the above and other objects, the present invention provides a printing system including a first printing unit and a second printing unit. The first printing unit prints images on a first surface of a web, and includes a mark forming unit that forms a positioning mark at a predetermined position of the web. The second printing unit prints images on a second surface of the web opposite from the first surface. At least the second printing unit further includes a mark detection means for detecting the positioning mark formed by the mark forming unit and outputting a mark detection signal accordingly, a calculation means for calculating an appropriate transport speed of the web based on an output timing of the mark detection signal, a memory means for storing a first information on the transport speed of the web calculated by the calculation means, and a control means for controlling a transport speed of the web based on the first information stored in the memory means at least for a period until the mark detection means detects the positioning mark for a first time after a printing operation was started.

There is also provided a printing system including a first printing unit and a second printing unit. The first printing unit prints images on a first surface of a web, and includes a mark forming unit that forms a positioning mark at a predetermined position of the web. The second printing unit prints images on a second surface of the web opposite from the first surface, and includes a transport means for transporting the web. At least the second printing unit further includes a mark detection means for detecting the positioning mark formed by the mark forming unit and outputting a mark detection signal accordingly and a control means for controlling a transport speed of the web based on an output timing of the mark detection signal. The control unit includes a microcomputer that designates a first value and a second value, a first signal process portion including a first counter that stops counting at the output timing of the mark detection signal, a second signal process portion including a second counter that is set to the first value designated by the microcomputer, the second counter outputting a pulse indicating a start timing of web transport, and a web transport control portion that controls the transport means to start transporting the web in response to the pulse from the second counter and that controls the web transport speed based on the second value. The microcomputer designates the second value based on the count value of the first counter at the time of when the first counter stops counting.

Further, there is provided a printing method for printing images on both first and second surfaces of a web. The method comprising the steps of a) forming a positioning mark at a predetermined position in addition to an image on a first surface of the web using a first printing unit, b) controlling a transport speed of the web in a second printing unit based on a first information that has been stored in a memory means, at least for a period until the positioning mark is detected in the step c) for a first time after a printing operation was started, the first information being on a transport speed of the web calculated by a calculation means during a previous printing operation, c) detecting the positioning mark using a detection unit of the second printing unit, and generating a mark detection signal accordingly, d) calculating an appropriate transport speed of the web based on an output timing of the mark detection signal, and e) updating the first information stored in the memory means.

DETAILED DESCRIPTION OF THE EMBODIMENT

Next, a dual surface printing system 100 according to the present invention will be described with reference to the attached drawings.

Figure 1:
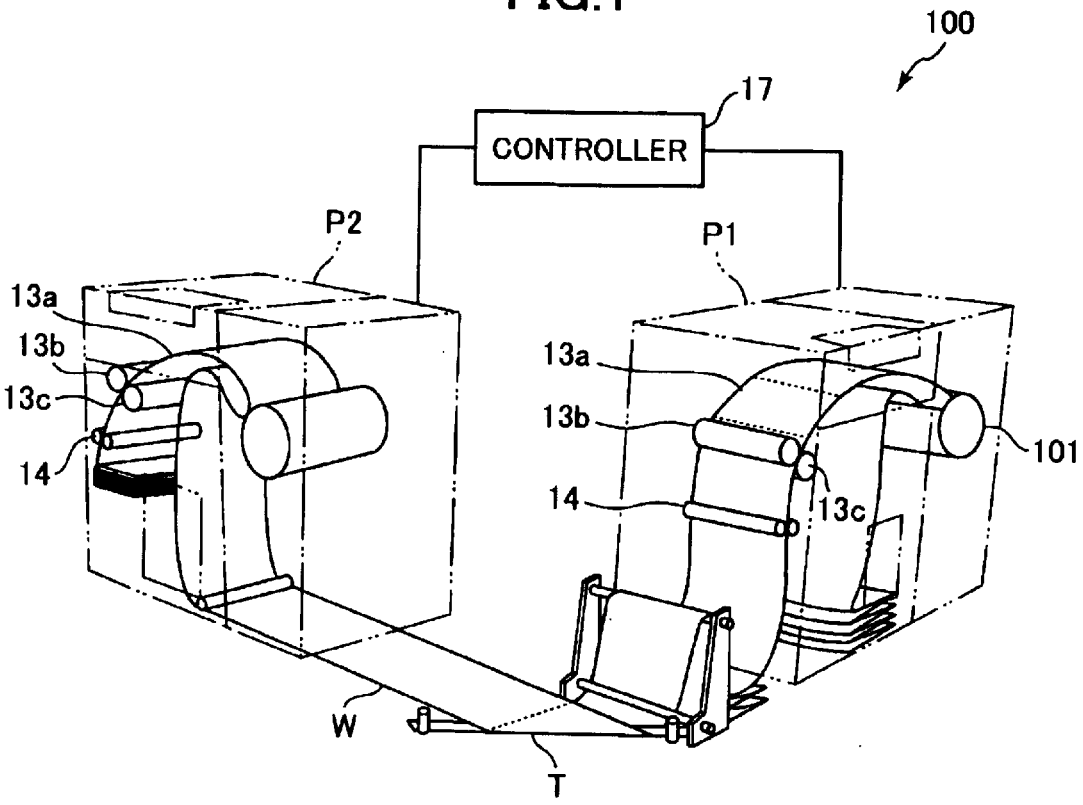
FIG. 1 is a perspective phantom view showing overall configuration of a dual surface printing system according to an embodiment of the present invention.

As shown in FIG. 1, the dual surface printing system 100 according to the present invention includes two print units P1, P2, a control unit 17 connected to the print units P1, P2, and an inversing unit T. Both the print units P1, P2 are electrophotographic printers in this embodiment. The print unit P1 performs printing on a front surface of a web W. The web W fed out from the first print unit P1 is turned over by the inversing unit T, and then supplied into the second print unit P2, whereupon the second print unit P2 performs printing on a rear surface of the web W. The web W is typically paper. However, the web W is not limited to paper and can be other materials, such as plastic film.

Next, configuration of the print units P1, P2 will be described. It should be noted that both the print units P1, P2 have basically the same configuration, only the print unit P1 will be described, and explanation of the print unit P2 will be omitted in order to avoid duplication in explanation.

Figure 2:
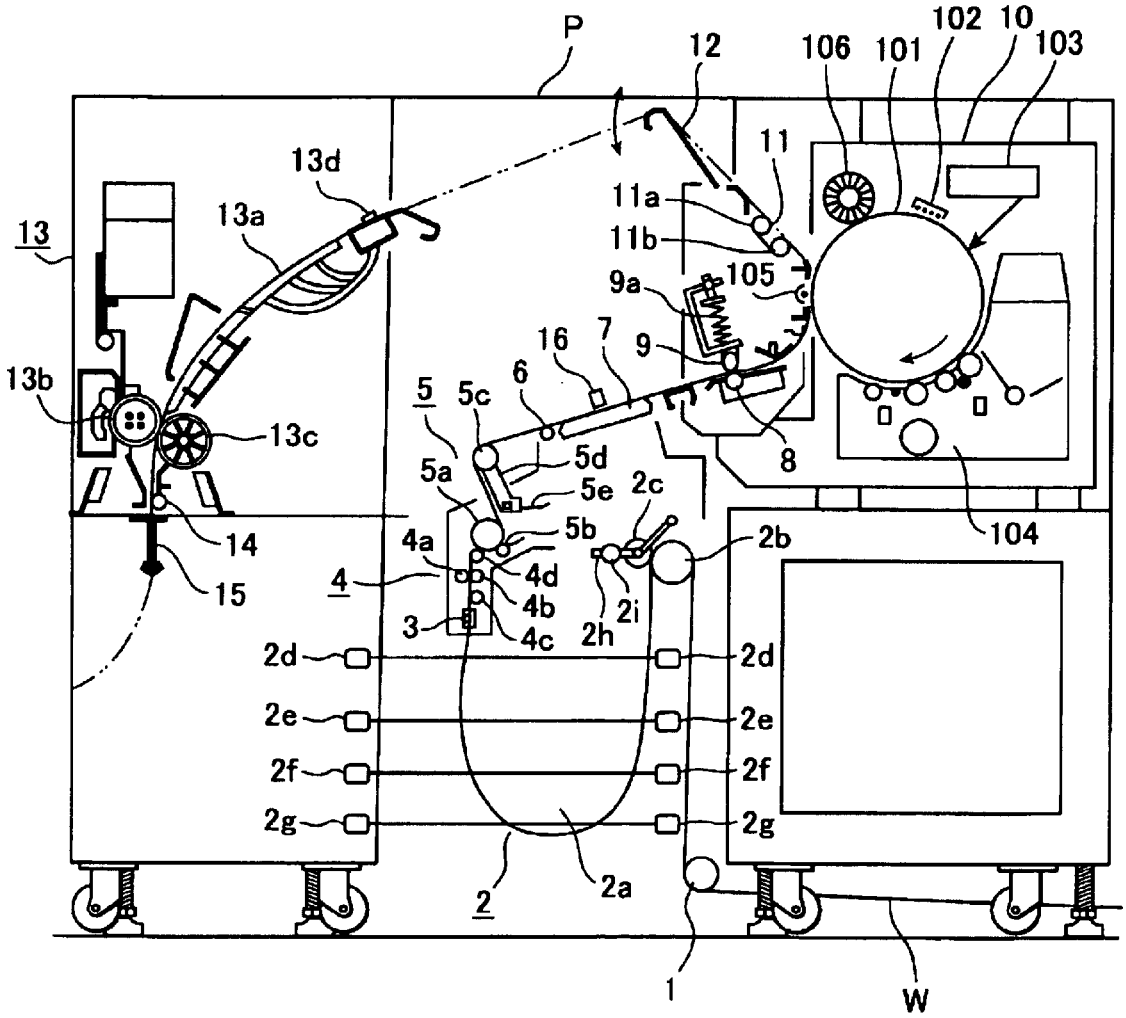
FIG. 2 is a diagram showing an overall configuration of a print device of the dual surface printing system of FIG. 1.

As shown in FIG. 2, the print unit P1 includes a guide roller 1, a web buffer mechanism 2, a foreign-matter removing mechanism 4, a tension application mechanism 5, a printing unit 10, and a fixing unit 13. A feed unit (not shown) feeds the web W into the print unit P1 from the right side as viewed in FIG. 1. Then, the guide roller 1 guides the web W to the web buffer mechanism 2.

The web buffer mechanism 2 includes a storage unit 2*a*, a pair of rollers 2*b*, 2*c*, pairs of optical sensors 2*d*, 2*e*, 2*f*, and 2*g*, and a guide member 3. The storage unit 2*a* is for temporarily storing the web W being transported. The rollers 2*b*, 2*c* are provided upstream from the storage unit 2*a* with respect to a web-transport direction in which the web W is transported. A weight 2*i* is slidably provided on a shaft 2*h* that protrudes from one end of the roller 2*c*. By changing the position of the weight 2*i*, the pressing force of the roller 2*c* against roller 2*b* can be adjusted. The pairs of optical sensors 2*d*, 2*e*, 2*f*, and 2*g* are for detecting a buffer amount of the web W. Further explanation of the web buffer mechanism 2 will be omitted. It should be noted that detailed explanation of the web buffer mechanism 2 is disclosed in U.S. patent application Ser. No. US 2002/0081132 AI.

After passing through the guide member 3, the web W is fed into the foreign-matter removing mechanism 4. The foreign-matter removing mechanism 4 includes fixed shafts 4*a*, 4*b*, 4*c*, and 4*d*. The shaft 4*a* is separated by a predetermined extremely narrow gap from the shaft 4*b*, and this narrow gap prevents foreign matter from entering further into the print unit P1.

The web W is further transported to the tension application mechanism 5, which maintains a fixed tension on the web W. The tension application mechanism 5 includes a drums 5*a*, 5*c*, a roller 5*b*, a pivotably supported arm 5*d*, and a spring 5*e*. The drum 5*a* does not have its own drive source, and the roller 5*b* is provided in pressing contact with the drum 5*a*. The drum 5*c* is movably supported along the transport pathway of the web W and fixed to the free end of the arm 5*d*. The spring 5*e* is connected to the arm 5*d* to urge the drum 5*c* toward the surface of the web W.

Transport rollers 8, 9 transport the web W past a guide shaft 6 and a guide plate 7 to the printing unit 10. The transport roller 8 is driven by a motor and serves as a drive roller. The transport roller 9 is resiliently pressed against the transport roller 8 by a spring 9*a* and serves as a follower roller that is rotated by pressing contact with the transport roller 8 through the web W.

The printing unit 10 according to the present embodiment is an electrophotographic printing unit. The printing unit 10 includes a photosensitive drum 101, a corona charge unit 102, a light source 103, a developing unit 104, a transfer unit 105, and a cleaning unit 106. When rotation of the photosensitive drum 101 starts, a high voltage is applied to the corona charge unit 102, so that the corona charge unit 102 charges the surface of the photosensitive drum 101 to a uniform charge. In the present embodiment, the surface of the photosensitive drum 101 is charged to a positive charge. The light source 103 is configured from a semiconductor laser or a light emitting diode, and a light output from the light source 103 forms an electrostatic latent image on the surface of the photosensitive drum 101. When the electrostatic latent image comes into confrontation with the developing unit 104, then the developing unit 104 selectively supplies toner, which is a developing agent, to the surface of the photosensitive drum 101, thereby developing the electrostatic latent image into a toner image. The transfer unit 105 is charged with a polarity opposite from the polarity of the toner image, that is, the transfer unit 105 is charged with a negative charge in the present embodiment. Accordingly, when the toner image formed on the surface of the photosensitive drum 101 reaches a transfer position where the photosensitive drum 101 confronts the transfer unit 105 via the web W, the toner image is drawn onto the web W by this negative charge. Then, the cleaning unit 106 cleans regions of the photosensitive drum 101 that have past by the transfer position.

After the toner image is transferred onto the web W, a transport belt 11 transports the web W in the web-transport direction. The transport belt 11 is supported spanning between a drive roller 11*a* and a follower roller 11*b*. Although not shown in the drawings, a suction unit is provided on the transport belt 11 that suck the rear side of the web W through the transport belt 11 so that the web W is transported clinging to the transport belt 11.

The web W fed out by the transport belt 11 is further transported to the fixing unit 13 via a buffer plate 12. The fixing unit 13 includes a pre-heater 13*a*, a thermal roller 13*b*, and a pressing roller 13*c*. The pressing roller 13*c* is disposed in pressing contact with the thermal roller 13*b*, thereby defining a nip portion between the thermal roller 13*b* and the pressing roller 13*c*. When the web W reaches the fixing unit 13, first the web W is preheated by the preheater 13*a*. Then, the web W is thermally pressed at the nip portion between the fixing rollers 13*b*, 13*c* while being transported by the fixing rollers 13*b*, 13*c*. At this time, the toner image is thermally fused to the web W.

The web W discharged from the fixing unit 13 is further transported via a feed roller 14. Normally, the web W is folded back and forth into an accordion fold by the swing movement of a swing fin 15 and stored in the print unit P1. However, because the print unit P2 is disposed behind the print unit P1 in this printing system 100, the web W discharged from the fixing unit 13 is discharged outside the print unit P1 via the discharge roller 14 as indicated by a broken line in FIG. 2.

The print unit P1 further includes a sensor 13*d* for detecting the winding path of the web W and a mark sensor 16 for detecting a positioning mark (described later), which is formed on the web W. The mark sensor 16 is absolutely necessary in the second print unit P2. As will be described later, the first print unit P1 prints the positioning mark at, for example, the page head of each page in addition to front-surface images on the front surface of the web W. Then, the second print unit P2 detects the positioning mark and, based on the detection result, performs control operations to insure that rear-surface images are printed on the rear surface of the web W at positions that accurately match the positions of front-surface images.

Next, printing operation of the printing system 100 will be described.

Figure 3:
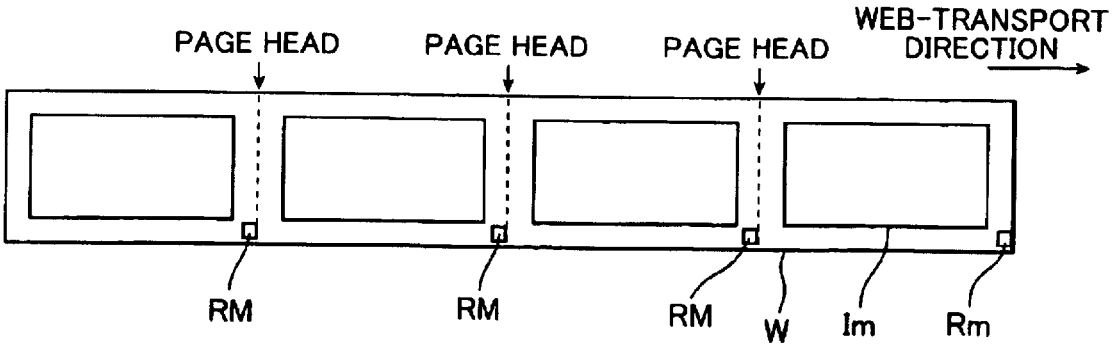
FIG. 3 is a plan view of a web printed with positioning marks.

First, as shown in FIG. 3, the first print unit P1 forms on the front surface of the web W an image Im based on print data and in addition the positioning mark (toner marks) Rm at the page head of each page. The same unit can be used to form both the positioning mark Rm and the image Im, or a separate unit can be provided for forming the positioning mark Rm. In the present embodiment, the same unit is used to form both the positioning mark Rm and the image Im, and the positioning mark Rm is formed at the same time as the image Im.

The web W discharged from the first print unit P1 is inverted upside down by the inverting unit T, and then supplied into the second print unit P2. By inverting the web W upside down by the inverting unit T, the front surface of the web W formed with the images Im and the positioning marks Rm comes into confrontation with a detection surface of the mark sensor 16 in the print unit P2, and the rear surface of the web W, which is still unprinted at this time, comes into confrontation with the surface of the photosensitive drum 101.

When the light source 103 of the first print unit P1 starts irradiating a laser light for forming an electrostatic image corresponding to a positioning mark Rm, which is to be formed at the page head of each page, then the controller 17 outputs a web-transport control signal (hereinafter referred to as "CPF-N signal") at a timing synchronized with the start of irradiation. Similarly, the light source 103 of the second print unit P2 starts irradiating a laser light for each page at a timing that is independent of the first print unit P1, and the controller 17 generates the CPF-N signal at this irradiation start timing. Although the first print unit P1 and the second print unit P2 generate the CPF-N signals at independent timings, a time interval between two successive CPF-N signal is the same between the first print unit P1 and the second print unit P2. The CPF-N signals generated by the controller 17 are transmitted to both the first print unit P1 and the second print unit P2 and, as to be described later, a motor control signal for controlling web-transport speed is produced based on the CPF-N signals. It should be noted that the operation of generating pulse signals in synchronization with irradiation of a laser light itself is well known, so detailed description thereof will be omitted.

Figure 4:
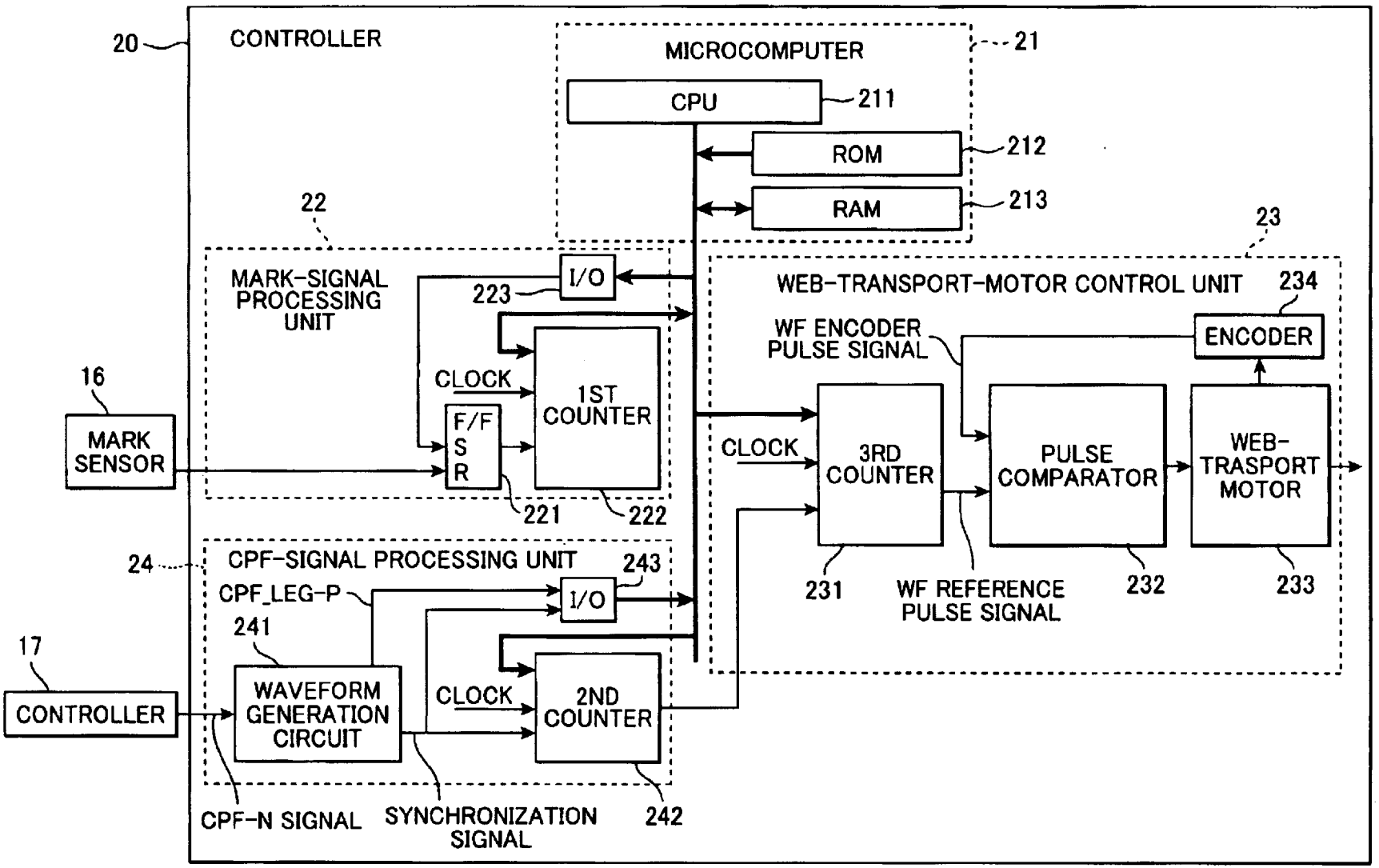
FIG. 4 is a block diagram of a controller provided to a print device.

In addition to the above configuration, the second print unit P2 includes a controller 20 shown in FIG. 4 for matching positions of images on the front and rear surfaces of the web W. The controller 20 includes a microcomputer 21, a mark-signal processing unit 22, a web-transport-motor control unit 23, and a CPF-signal processing unit 24. The microcomputer 21 includes a central processing unit (CPU) 211, a read only memory (ROM) 212, and a random access memory (RAM) 213. The CPU 211 is for executing calculation and control of other components. The ROM 212 stores operation programs of the CPU 211, such as a position-alignment program to be described later. The RAM 213 is for temporarily storing calculation results, variables, and the like generated during execution of programs.

The mark-signal processing unit 22 includes a flip-flop 221, a first counter 222, and an I/O device 223. The flip-flop 221 is connected to the mark sensor 16. The first counter 222 starts counting at a clock when a signal from the I/O device 223 is applied to a set terminal S of the flip-flop 221, and the first counter 222 stops counting at the clock when the mark detection signal from the mark sensor 16 is input to a reset terminal R of the flip-flop 221.

The web-transport-motor control unit 23 includes a third counter 231, a pulse comparator 232, a web-transport motor 233, and an encoder 234. The third counter 231 outputs a WF reference pulse signal when the third counter 231 counts down to 0 from an initial count value, which is set by the microcomputer 21. The web-transport motor 233 is for driving the transport roller 8 or the like to transport the web W. The encoder 234 outputs a WF encoder pulse signal in synchronization with the driving movement of the web-transport motor 233. Both the WF reference pulse signal and the WF encoder pulse signal are input to the pulse comparator 232, so that the pulse comparator 232 compares the WF encoder pulse signal with the WF reference pulse signal and controls the driving speed of the web-transport motor 233 based on these signals in a manner described later.

The CPF-signal processing unit 24 includes a waveform generation circuit 241, a second counter 242, and an I/O device 243.

Next, basic principles behind the control for matching positions of images on the front and rear surfaces of the web W will be described.

Figure 5:
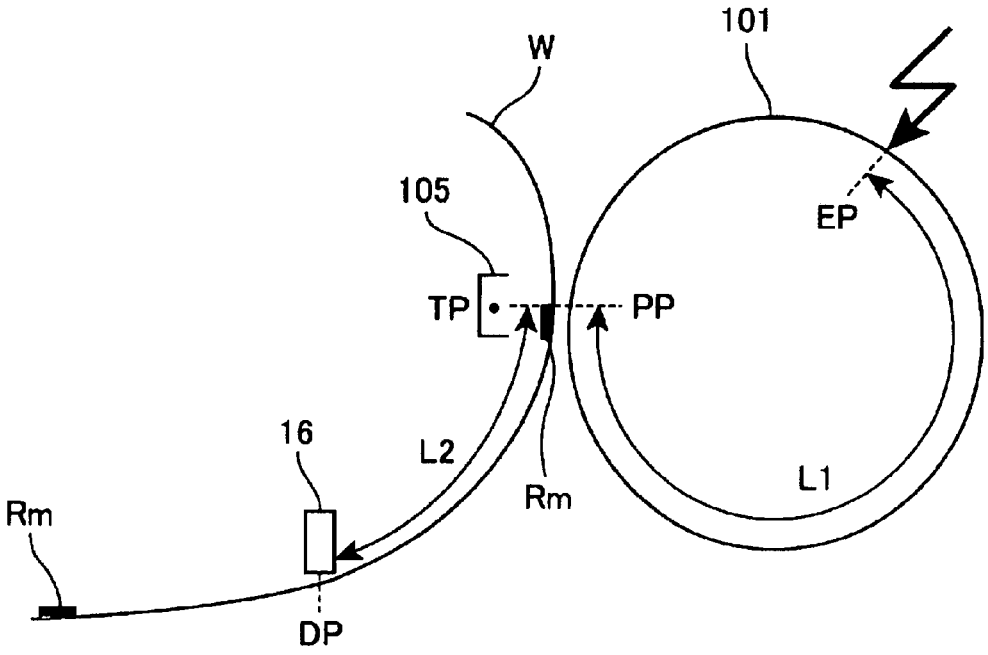
FIG. 5 is a diagram for explaining a position alignment control.

FIG. 5 is a schematic view for explaining positioning control operations. During printing operations, the photosensitive drum 101 rotates at a predetermined process speed Vp, and toner images formed on the photosensitive drum 101 are transferred onto the surface of the web W at a transfer point TP shown in FIG. 5 where the photosensitive drum 101 contacts the web W. The controller 20 controls a web-transport speed such that a positioning mark Rm on the web W and a corresponding position PP that is imaginary defined on the surface of the photosensitive drum 101 meet at the transfer point TP in order to achieve the positional alignment between the front-surface images and the rear-surface images.

In other words, the position PP indicates a position of a page head on the photosensitive drum 101. As mentioned above, in the print unit P2, each time the light source 103 starts irradiation for each page, the controller 17 produces the CPF-N signal shown in FIG. 6. Because the photosensitive drum 101 rotates at the fixed process speed Vp, the position PP reaches the transfer point TP at the cycle of the CPF-N signal, that is, each time the web W is transported by the length of CPF-N signal (CPF length). Accordingly, by controlling the web-transport speed so that the difference between the generation timing of the CPF-N signal and the detection timing of the positioning mark Rm is fixed, the position PP on the photosensitive drum 101 and the corresponding positioning mark Rm at the page head of the web W can be precisely matched at the transfer point TP.

As shown in FIG. 5, there is a moving distance L1 of the photosensitive drum 101 from an irradiation point EP to the transfer point TP. The irradiation point EP is where the laser beam from the light source 103 is irradiated on the photosensitive drum 101. Also, there is a moving distance L2 of the web W from a detection point DP where the mark sensor 16 detects the positioning mark Rm to the transfer point TP.

In order to make the position PP and the corresponding positioning mark Rm to reach the transfer point TP at the same time, the position PP should be located upstream from the transfer point TP by the distance L2 at the time of when the mark sensor 16 detects the corresponding positioning mark Rm at the detection point DP that is upstream from the transfer point TP by the distance L2.

Figure 6:
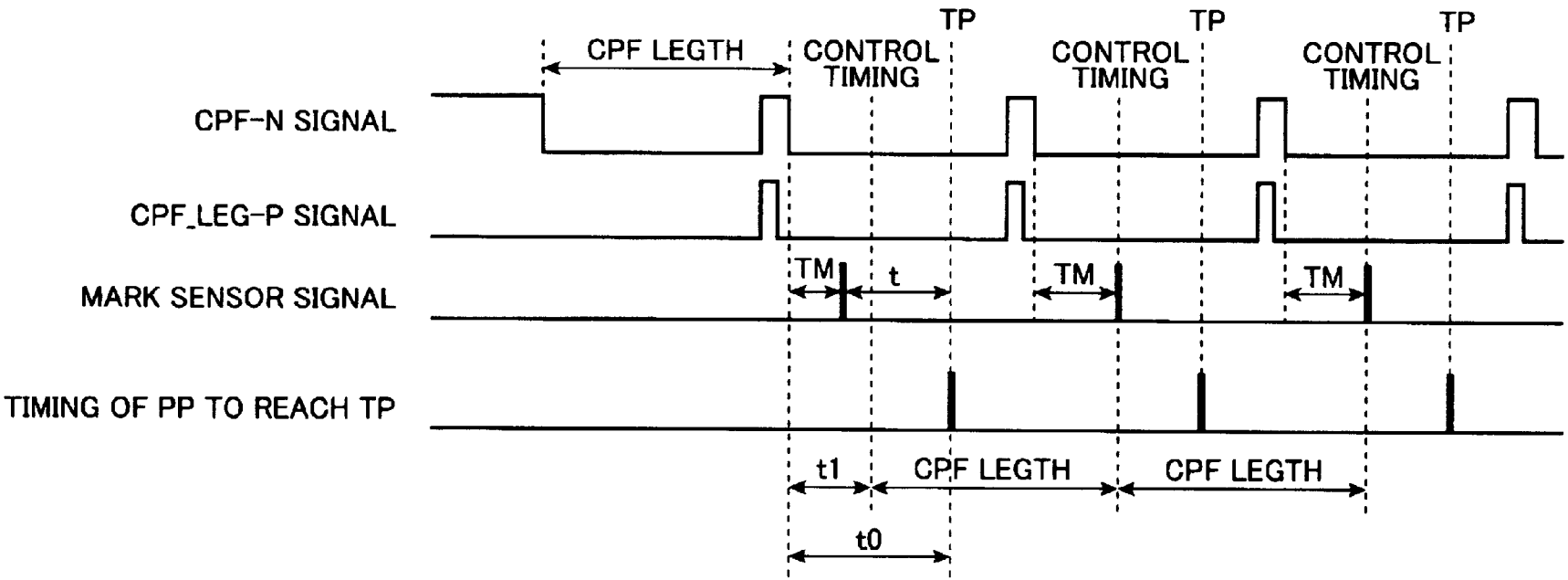
FIG. 6 is a timing chart explaining web-transport control of the present embodiment.

In the present embodiment, "control timing" will be referred to a theoretical detection timing of the positioning mark Rm when the web W is being transported in an appropriate web-transport speed wherein the positioning mark Rm will meet a corresponding position PP at the transfer point TP so that a rear-surface image is formed in the same positional phase as a corresponding front-surface image. With this definition, positioning of a rear-surface image is controlled so that the actual detection timing constantly matches the control timing. That is, mark detection signals shown in FIG. 6 are controlled to match the control timings.

A position PP indicating a page head position on the photosensitive drum 101 reaches the transfer point TP after a time t0 elapses from when the irradiation is started for a page. The time t0 is determined by dividing the distance L1 by the process speed Vp (L1/Vp) and is shown in FIG. 6 as a time from the lowering edge of the CPF-N signal to the time noted as the transfer point TP. The process speed Vp equals to the rotational speed of the photosensitive drum 101.

On the other hand, the positioning mark Rm reaches the transfer point TP after a time t elapses from when the mark sensor 16 detects the positioning mark Rm. The time t is determined by dividing the distance L2 by a web-transport speed Vw (i.e., t=L2/Vw) and is shown in FIG. 6 as the time from the mark detection signal to the transfer point TP. Accordingly, a mark detection time tm from the lowering edge of the CPF-N signal to the mark detection signal is determined by subtracting the time t from the time t0 (i.e., tm=t0−t). Further, a time t1 from the lowering edge of the CPF-N signal to the control timing is determined by the following equation:

$$t1=(L1=L2)/vp \tag{1}$$

If the mark detection time tm matches the time t1, then the positions of page heads of the front and rear-side pages match each other. Therefore, by calculating the shift between the time mark tm and the time t1 using equation (1) each time the mark sensor 16 outputs a detection signal and by controlling the web-transport speed until the shift is reduced to zero, positioning alignment is achieved. Said differently, the time shift between the control timing and the detection timing of the positioning mark Rm is used to determine the extent that the page head on the rear surface is shifted from the page head on the front surface. If the detection timing of the positioning mark Rm is later than the control timing, then the web-transport speed is increased. On the other hand, if the detection timing of the positioning mark Rm is before the control timing, then the web-transport speed is decreased. In this manner, the web-transport speed is controlled until the detection timing of the positioning mark Rm matches the control timing.

With this method, however, control for matching positions of the front and rear pages does not start until the mark sensor 16 first detects the positioning mark Rm after printing has been started. That is, at first positioning control is not performed.

To overcome this problem the controller 20 of the present embodiment stores the mark detection time tm and the adjusted web-transport speed to the RAM 213 each time the positioning mark Rm is detected. Then a web-transport speed during the period until the positioning mark Rm is first detected is controlled to be the same as the web-transport speed stored in the RAM 213. This enables suppressing the shift between printing positions on the front surface and printing positions on the rear surface to a minimum. Details will be described.

As mentioned previously, the controller 17 generates a CPF-N signal in synchronization with the exposure timing of the second print unit P2. The CPF-N signal is supplied to the waveform forming circuit 241 of the CPF-signal processing unit 24 shown in FIG. 4, which in turn generates a web transport control signal (hereinafter referred to as "CPF_LEG-P signal") shown in FIG. 6. The CPF_LEG-P signal is made by forming the pulse width extremely small for retrieving only timing information of the CPF-N signal. In addition, the waveform forming circuit 241 of the CPF-signal processing unit 24 also generates a synchronization signal synchronized with the lowering edge of the first CPF-N signal. When the microcomputer 21 receives the synchronization signal through the I/O device 243, then the CPU 211 stores a count value into the second counter 242 and controls the second counter 242 to start counting down the count value by a clock. In other words, the second counter 242 starts the countdown at the timing of the lowering edge of the first CPF-N signal. When the count value reaches 0, then the second counter 242 applies an output pulse to the web-transport-motor control unit 23. That is, the output pulse is generated after a time that is designated by the CPU 211 elapses from the lowering edge of the CPF-N signal. In response to the output pulse, the web-transport motor 233 starts driving the transport roller 8 to transport the web W.

On the other hand, the mark-signal processing unit 22 has a function for measuring the mark detection time tm shown in FIG. 6. That is, the synchronization signal output from the waveform generation circuit 241 is also applied to the set terminal S of the flip-flop 221 through the I/O device 223, and the first counter 222 starts counting a clock. When the mark detection signal from the mark sensor 16 is applied to the reset terminal R of the flip-flop 221, then the first counter 222 stops counting. In this manner, the first counter 222 measures the mark detection time tm, that is, the time from the lower edge of the CPF-N signal to the detection timing of the positioning mark Rm. Then, this time information is retrieved by the CPU 211 as a mark detection time tm.

The web-transport-motor control unit 23 includes a function for driving the web transport motor 233 at a speed designated by the CPU 211. More specifically, the third counter 231 is set to have a count value from the CPU 211, and starts counting down at the clock at the time of when the output pulse is input from the second counter 242. When the count value reaches 0, then the third counter 231 generates an output signal. That is, the frequency of the output pulse from the third counter 231 can be changed as desired by changing the count value from the CPU 211.

Figure 7:
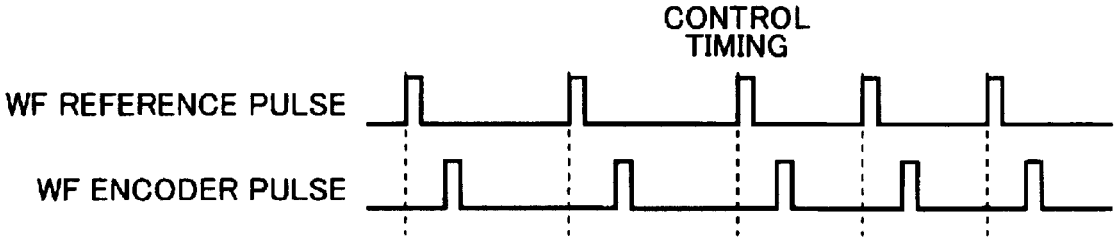
FIG. 7 is a timing chart showing pulses used for speed control of a web-transport motor of the present embodiment.

FIG. 7 shows the relationship of the WF reference pulse signal and the WF encoder pulse signal. Because the pulse comparator 232 controls the web-transport motor 233 so that the WF encoder pulse signal follows the WF reference pulse signal, it is possible to control motor speed of the web-transport motor 233 in accordance with the count value of the third counter 231. That is, increasing the count value of the third counter 231 decreases the web-transport speed, and decreasing the count value of the third counter 231 increases the web-transport speed.

Figure 8:
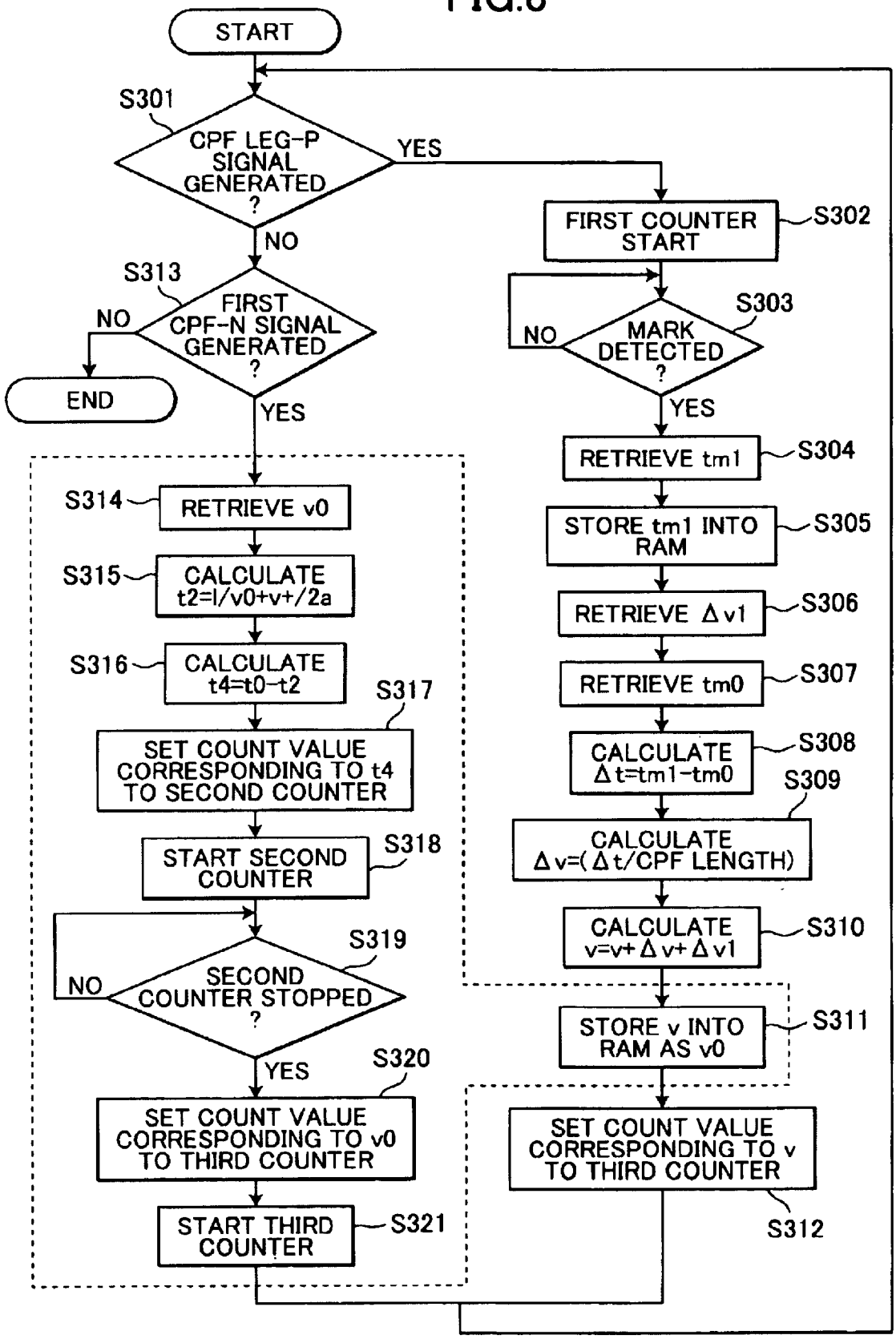
FIG. 8 is a flowchart representing a position-alignment program.

Next, the position-alignment program according to the present embodiment will be described with reference to the flowchart of FIG. 8.

In S301, it is judged whether or not a CPF_LEG-P signal was generated. When the printing is just started, the CPF_LEG-P is generated only after a first CPF-N signal is generated (see FIG. 6). Therefore, a negative determination is made in S301 in a first routine (S301:NO), and then the process proceeds to S313 to determine if the first CPF-N signal was generated. If not (S313:NO), the process ends. On the other hand, if so (S313:YES), then the process proceeds to S314.

In S314, a speed v0 is retrieved from the RAM 213. Here, the speed v0 is a web-transport speed in a previous printing operation and has been stored in the RAM 213 in a manner described later. Then, processes for accelerating the web transport motor 233 to the target speed v0 is executed in the following steppes.

When the target speed of the web transport motor 233 is changed, the time required to attain a desired web transport amount also changes. Accordingly, to match the timing at which the position PP for the first page on the photosensitive drum 101 and the positioning mark Rm of the first page of the web W at the transfer point TP, the timing to start transporting the web W is changed according to the target speed of the web transport motor 233.

Figures 9, 10:
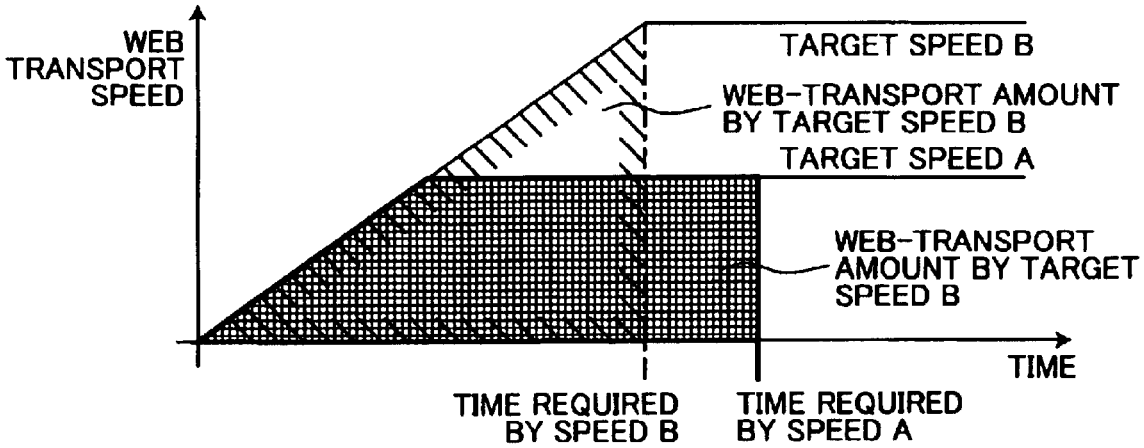
FIG. 9 is a table showing relationship between time difference and web-transport speed update amounts.
FIG. 10 is a graph showing changes, caused by target speed, in time required to transport a web by a predetermined distance.

FIG. 10 shows changes, caused by target speed, in time required to transport the web W by a predetermined distance from when the web-transport motor 233 has started driving. The vertical axis represents a web-transport speed, and the horizontal axis represents time. The distance that the web W is transported is represented by surface area. A time T2 required to obtain a predetermined web-transport distance increases when the web W is transported at a slower target speed A than a target speed B. The time t2 can be calculated using the following equation:

$$t2=l/v0+v0/2a \tag{2}$$

wherein v0 is the target speed of the web-transport motor 233;

a is the acceleration rate; and l is a web-transport amount.

Referring to FIGS. 5 and 6, the time t0 required for the photosensitive drum 101 to move by the distance L1 from the exposure position EP to the transfer point TP, that is, from the lowering edge of the CPF-N signal to the transfer point TP, is unchanging at L1/Vp. On the other hand, web transport starts after a time t4 elapses from the lowering edge of the CPF-N signal. The following relationship needs to be established in order to match the positioning mark Rm, which indicates a page head of the web W, with the position PP at the transfer point TP after a time t2 elapses from when the web transport starts:

$$t4=t0-t2 \tag{3}$$

Accordingly, in S315, the time t2 is calculated using the formula (2), and in S316, the time t4 is calculated using the formula (3). In S317, a count value corresponding to the calculated time t4 is set to the second counter 242. In this manner, timing of starting web transport is controlled in accordance with the target speed v0. That is, in S318, the second counter 242 starts counting down when the synchronization signal generated in the waveform generation circuit 241 is applied to the CPU 211. In S319 it is determined whether or not the first counter 222 has stopped counting down in response to the mark detection signal. If not (S319:NO), then the process waits until a positive determination is made in S319. If so (S319:YES) then in S320, a count value corresponding to the speed v0 is set to the third counter 231. The third counter 231 starts countdown in S321, and the process returns to S301. In this manner, the web transport motor 233 is controlled in accordance with the speed v0.

Here, the above processes in S314 to S321 are executed during a period from the generation timing of the first CPF-N signal to a first detection timing of the positioning mark Rm.

When the process returns to S301, a positive determination is made this time (S301:YES), and the process proceeds to S302, where the first counter 222 starts counting at the clock in order to measure the mark detection time tm. Then in S303, it is judged whether or not the mark sensor 16 generated a mark detection signal. If not (S303:NO), the process waits until a positive determination is made in S303. If so (S303:YES), then this means that the first counter 222 has stopped counting. In S304, the count value of the first counter 222 is retrieved as a mark detection time tm1 from the first counter 222 in S304, and then in S305, the mark detection time tm1 is stored in the RAM 213.

Next in S306, a web-transport speed update amount Δv1 is retrieved in a following manner. That is, first a time t1 is calculated using equation (1), and then a difference between the time t1 and the mark detection time tm1 is calculated. As described previously, position of pages on upper and lower sides of the web W are matched by controlling web-transport speed such that the difference between the time t1 and the mark detection time tm1 becomes zero (tm1−t1=0). Therefore, in the present embodiment, a control amount that corresponds to the difference is determined as the web-transport speed update amount Δv1. In the present embodiment, the relationship between the difference (tm1−t1) and the web-transport speed update amount Δv1 is prestored in the RAM 213 or the ROM 212 in a table form as represented in FIG. 9, and the web-transport speed update amount Δv1 is obtained by referring to the table.

In the table of FIG. 9, the web-transport speed update amount Δv1 is zero for when the difference between the mark detection time tm1 and time t1 is zero. Web-transport speed update amounts Δv1 are positive when the mark detection time tm1 is greater than the time t1 (tm1>t1), that is, when the page head on the front side is behind the page head for the rear side of the web. The positive amounts gradually increase with increase in the delay. Contrarily, web-transport speed update amounts Δv1 are negative when the mark detection time tm1 is less than the time t1 (tm1<t1), that is, when the page head on the front side is ahead of the page head for the rear side of the web. The negative amounts gradually increases with increase in the advance.

In the present embodiment, the motor speed is control using conventional methods, such as proportion and differentiation. The process of S306 is for the proportion control, and processes of S307, 308, and S309 are for the differentiation control.

Next, in S307, a previous mark detection time tm0 is retrieved, and in S308, a time difference Δt is calculated by subtracting the previous mark detection time tm0 from the present mark detection time tm1 (Δt=tm1−tm0). Then, in S309, a web-transport speed change amount Av is calculated using the following equation:

$$\Delta v=(\Delta t/CPF\ \text{length})\times v \quad (4)$$

wherein v is a current web-transport speed, that is, a web-transport speed at the mark detection time tm1.

That is, the web-transport speed change amount Δv is the rate of Δt with respect to the CPF length, and web-transport speed is accelerated or decelerated at the time by the web-transport speed change amount Δv.

In S310, a web-transport speed v is updated by adding the web-transport speed change amount Δv and the web-transport speed update amount Δv1 retrieved in S306 to the web-transport speed v (v=v+Δv+Δv1). In S311, the updated web-transport speed v is stored in the RAM 213 as v0. This value of v0 is used during the period from the start of subsequent printing operation until a positioning mark Rm is first detected, which has conventionally been non-control period. Then, in S312, a count value corresponding to the updated web-transport speed v is set to the third counter 231, and the process returns to S301. Then, the processes from S301 to S312 are repeated until the printing is completed, whereupon a negative determination is made both in S301 and S313 (S301, S313:NO), and the process ends.

As described above, according to the present embodiment, drive-start timing of the web-transport motor 233 and a target speed of the web-transport motor 233 are calculated using prestored data to match positions even before a positioning mark Rm is first detected in order to control the positioning alignment between front pages and rear pages. Therefore, the uncontrolled periods of the conventional technology are reduced.

That is, data relating to the web-transport speed calculated each time the toner mark is detected is stored in a memory. The data is used during a period from when the web transport is started at the start of a printing operation to when the mark sensor first detects a positioning mark. By this, position control can be performed even before the positioning mark is first detected. For this reason, the image on the front surface and the image on the rear surface can be positioned in an extremely short time. The position of the image on the front and rear surface can be properly aligned during printing.

While some exemplary embodiments of this invention have been described in detail, those skilled in the art will recognize that there are many possible modifications and variations which may be made in these exemplary embodiments while yet retaining many of the novel features and advantages of the invention.

For example, the embodiment describes the controller 20 being provided in the second print unit P2 and providing the separate controller 17. However these two controllers can be combined into a single controller.

The embodiment describes providing three counters 222, 242, and 231 in the controller 20. However, these counters can be configured from software operations.

Although the printing unit 10 according to the above embodiment is an electrophotographic printing unit, this should not be taken as a limitation of the present invention.

What is claimed is:

1. A printing system comprising:

a first printing unit that prints images on a first surface of a web, the first printing unit including a mark forming unit that forms a positioning mark at a predetermined position of the web; and a second printing unit that prints images on a second surface of the web opposite from the first surface, wherein at least the second printing unit includes:

a mark detection means for detecting the positioning mark formed by the mark forming unit and outputting a mark detection signal accordingly;

a calculation means for calculating an appropriate transport speed of the web based on an output timing of the mark detection signal;

a memory means for storing a first information on the transport speed of the web calculated by the calculation means; and a control means for controlling a transport speed of the web based on the first information stored in the memory means at least for a period until the mark detection means detects the positioning mark for a first time after a printing operation was started.

2. The printing system according to claim 1, further comprising a signal generation means for generating a transport-control signal at a predetermined timing, wherein the memory means also stores a second information on a time difference between a timing of the transport-control signal and an output timing of the mark detection signal.

3. The printing system according to claim 2, wherein the second printing unit further includes an irradiation means for irradiating a laser beam for each page, and the signal generation means generates the transport-control signal each time the irradiation means starts the irradiation for a page, and the mark forming unit forms the positioning mark at a page head of each page defined on the first surface of the web.

4. The printing system according to claim 2, wherein the second printing unit further includes a transport means for transporting the web, and the control means controls the transport means to start transporting the web after a predetermined duration of time elapses from when the transport-control signal is first generated.

5. The printing system according to claim 4, wherein the control means includes:

a counter that starts countdown from an initial count value at the timing of the transport-control signal;

a processor that sets the initial count value to the counter, the initial count value being corresponding to the predetermined duration of time; and an output generator that generates an output when the counter counted down to a predetermined value, wherein the transport means starts transporting the web in response to the output from the output generator.

6. The printing system according to claim 5, wherein the processor includes a determining means for determining the predetermined duration of time based on the transport speed of the web.

7. The printing system according to claim 2, wherein the control means controls the transport speed of the web after the mark detection means has detected the positioning mark for the first time, based on the second information previously stored in the memory means and on the time difference between the timing of a latest transport-control signal and the output timing of a latest mark detection signal.

8. The printing system according to claim 1, wherein the control means stores the second information each time the mark detection means detects the positioning mark.

9. The printing system according to claim 1, wherein the first printing unit and the second printing unit are electrophotographic printers including a photosensitive drum.

10. A printing system comprising:

a first printing unit that prints images on a first surface of a web, the first printing unit including a mark forming unit that forms a positioning mark at a predetermined position of the web; and a second printing unit that prints images on a second surface of the web opposite from the first surface, the second printing unit including a transport means for transporting the web, wherein at least the second printing unit includes:

a mark detection means for detecting the positioning mark formed by the mark forming unit and outputting a mark detection signal accordingly; and a control means for controlling a transport speed of the web based on an output timing of the mark detection signal, wherein the control means includes:

a microcomputer that designates a first value and a second value;

a first signal process portion including a first counter that stops counting at the output timing of the mark detection signal;

a second signal process portion including a second counter that is set to the first value designated by the microcomputer, the second counter outputting a pulse indicating a start timing of web transport; and a web transport control portion that controls the transport means to start transporting the web in response to the pulse from the second counter and that controls the web transport speed based on the second value, wherein the microcomputer designates the second value based on the count value of the first counter at the time of when the first counter stops counting.

11. The printing system according to claim 10, wherein the second counter starts counting up at fixed intervals during printing, and the microcomputer updates the second value based on the count value of the first counter.

12. A printing method for printing images on both first and second surfaces of a web, the printing method comprising the steps of:

a) forming a positioning mark at a predetermined position in addition to an image on a first surface of the web using a first printing unit;

b) controlling a transport speed of the web in a second printing unit based on a first information that has been stored in a memory means, at least for a period until the positioning mark is detected in the step c) for a first time after a printing operation was started, the first information being on a transport speed of the web calculated by a calculation means during a previous printing operation;

c) detecting the positioning mark using a detection unit of the second printing unit, and generating a mark detection signal accordingly;

d) calculating an appropriate transport speed of the web based on an output timing of the mark detection signal; and e) updating the first information stored in the memory means.

13. The printing method according to claim 12, further comprising the steps of:

f) generating a transport-control signal after the step a); and g) storing a second information on a time difference between a timing of the transport-control signal and an output timing of the mark detection signal into the memory means after the step c).

14. The printing method according to claim 13, wherein the transport-control signal is generated at the step f) when an irradiation means of the second printing unit starts irradiating a laser beam for a page, and the positioning mark is formed at the step a) at a page head of each page defined on the first surface of the web.

15. The printing method according to claim 13, wherein the step b) includes the step of h) controlling a transport means to start transporting the web after a predetermined duration of time elapses from when the transport-control signal is first generated at the step f).

16. The printing method according to claim 15, wherein the step h) includes the steps of i) setting an initial count value to a counter, the initial count value corresponding to the predetermined duration of time; j) starting countdown from the initial count value at the timing of the transport-control signal; k) generating an output when the count value was counted down to a predetermined value; and l) starting transport of the web in response to the output generated in the step k).

17. The printing system according to claim 13, further comprising the step of m) controlling the transport speed of the web, after the positioning mark was first detected in the step c), based on the transport speed of the web calculated in the step d), wherein the transport speed of the web is calculated in the step d) based further on the second information previously stored in the memory means in the step g).

18. The printing method according to claim 12, wherein the first printing unit and the second printing unit are electrophotographic printers including a photosensitive drum.

* * * * *

UNITED STATES PATENT AND TRADEMARK OFFICE

CERTIFICATE OF CORRECTION

PATENT NO. : 6,763,220 B2
DATED : July 13, 2004
INVENTOR(S) : Souichi Nakazawa

It is certified that error appears in the above-identified patent and that said Letters Patent is hereby corrected as shown below:

Column 14,
Line 52, delete “system” and insert -- method --.

Signed and Sealed this

Thirtieth Day of November, 2004

JON W. DUDAS
*Director of the United States Patent and Trademark Office*